United States Patent [19]

LaRue

[11] Patent Number: 5,048,428

[45] Date of Patent: Sep. 17, 1991

[54] CLIP-ON WORK SURFACE FOR A CHAIR TABLET

[76] Inventor: Mark C. LaRue, Route 13, Box 975, Leander, Tex. 78641

[21] Appl. No.: 544,583

[22] Filed: Jun. 27, 1990

[51] Int. Cl.[5] ..... A47B 13/08

[52] U.S. Cl. ..... 108/90; 297/160; 297/135

[58] Field of Search ..... 297/160, 161, 162, 135; 108/90, 44; 248/300, 225.3, 231.8, 227, 690

[56] References Cited

U.S. PATENT DOCUMENTS

| | | | |
|---|---|---|---|
| 1,364,022 | 12/1920 | Bauer . | |
| 1,414,452 | 5/1922 | Blauert . | |
| 1,752,102 | 3/1930 | Mew et al. . | |
| 2,175,572 | 10/1939 | Ruhl | 108/90 |
| 2,468,962 | 5/1949 | Czak | 108/90 |
| 2,529,051 | 11/1952 | Sherman | 108/90 |
| 2,556,943 | 6/1951 | Leisman | 108/90 |
| 2,659,641 | 11/1953 | Draxcer | 108/90 |
| 2,672,182 | 3/1954 | Gwin et al. | 108/90 |
| 2,720,913 | 10/1955 | Hoppert | 155/127 |
| 3,506,368 | 6/1971 | Guild | 297/161 X |
| 3,547,488 | 12/1970 | Barnes . | |
| 3,598,442 | 8/1971 | Miller . | |
| 4,003,598 | 1/1977 | Glaze | 297/161 X |
| 4,216,994 | 8/1980 | Benoit . | |
| 4,436,339 | 3/1984 | Albers . | |

FOREIGN PATENT DOCUMENTS

| | | | |
|---|---|---|---|
| 30337 | 1/1973 | Australia | 108/90 |
| 631508 | 8/1963 | Belgium | 297/160 |

*Primary Examiner*—Jose V. Chen

*Attorney, Agent, or Firm*—Walter C. Farley

[57] ABSTRACT

A generally flat add-on desk surface is provided with hooks and stop members so that the work surface can be attached to a tablet on a tablet arm chair. Hooks and fixed stop members engage side edges of the tablet to hold the added surface in position and a retractable stop member permits simple attachment and detachment. The surface is significantly larger than the surface of the original tablet and can be added for special purposes such as examinations and the like.

1 Claim, 3 Drawing Sheets

CLIP-ON WORK SURFACE FOR A CHAIR TABLET

This invention relates to an add-on desk top or work surface which quickly and easily can be attached to a tablet on a tablet chair to increase the available work surface particularly for examinations and the like.

BACKGROUND OF THE INVENTION

A tablet chair is a chair having an arm with an enlarged end portion at the front of the chair, relative to a person occupying the chair, to provide a work surface. Tablet chairs are commonly used in educational institutions to provide students with a surface for notebooks and the like so that notes can be taken, and for other purposes. Some such tablet chairs have enlarged work surfaces which are simply a fixed portion of the arm, the arm being a flat board shaped to form the arm as well as the work surface. Other tablet chairs have a forward portion which is hinged in some fashion with respect to the rest of the chair arm so that the tablet can be folded or swung to the side of the chair when not in use. Many varieties of such chairs have been developed, some constructed as individual chair units and others formed in interconnected rows for use in auditoriums and the like. Also, the technique for hinging or pivoting the tablet portion can take many forms.

The particular hinge arrangement or shape of the tablet is of relatively little significance to the present invention. Of particular importance is the fact that such tablets normally provide a work surface having an area in the order of 150 square inches or less. While this is adequate for the usual note taking during a class lecture, it is quite inadequate when students are taking examinations, particularly standardized tests such as the SAT and similar tests which tend to measure aptitude or achievement for purposes of evaluating students or schools. These tests are commonly given using a question booklet and one or more answer forms which, for convenient use, should be spread out on a desk in front of the student so that he can repeatedly refer back and forth between the booklet and answer sheet. Other test situations present similar requirements.

Many such tests are given in auditorium or other classroom situations where the seating involves tablet chairs and the tablets are simply too small to accommodate the test papers. While larger tablets could be substituted for the existing ones, this would involves substantial expense, not only for the additional tablets themselves, but for the labor in removing the original tablets and replacing them with larger ones. It would then be necessary to expend further labor cost to restore the original tablets since they could not be allowed conveniently to remain on the chairs.

SUMMARY OF THE INVENTION

Accordingly, an object of the present invention is to provide an easily attachable and detachable add-on work surface which can become a temporary attachment for the purpose of providing work area for examinations and the like.

Briefly described, the invention comprises a detachable member for increasing the work surface area of a tablet on a tablet chair, the tablet having a top surface, a bottom surface and four side edges, the detachable member comprising the combination of a substantially rigid generally planar body positionable for use on top of the tablet, the body having a top work surface with an area significantly greater than the top surface of the tablet and a bottom surface positionable on the top surface of the tablet. Hook means is attached to the body for extending under the tablet with the body positioned on top of the tablet such that the hook means engages two side edges and the bottom surface of the tablet. A first stop member protrudes from the bottom surface of the body, the first stop member being spaced from the hook means a sufficient distance to engage a third side edge of the tablet. A second stop member also protrudes from the bottom surface of the body and is positioned relative to the hook means and the first stop member so as to engage a fourth side edge of the tablet. One of the first and second stop members is retractable above the bottom surface to allow the body to be attached to and detached from the tablet. In the use position, the hook means and the stop members engage the various side edges of the tablet so that the body is firmly positioned on the tablet with the upper surface thereof available for use as a desk top or work surface.

BRIEF DESCRIPTION OF THE DRAWINGS

In order to impart full understanding of the manner in which the foregoing and other objects are attained in accordance with the invention, preferred embodiments thereof will be described with reference to the accompanying drawings, which form a part of this specification, and wherein.

DESCRIPTION OF THE PREFERRED EMBODIMENTS

Figure 1:
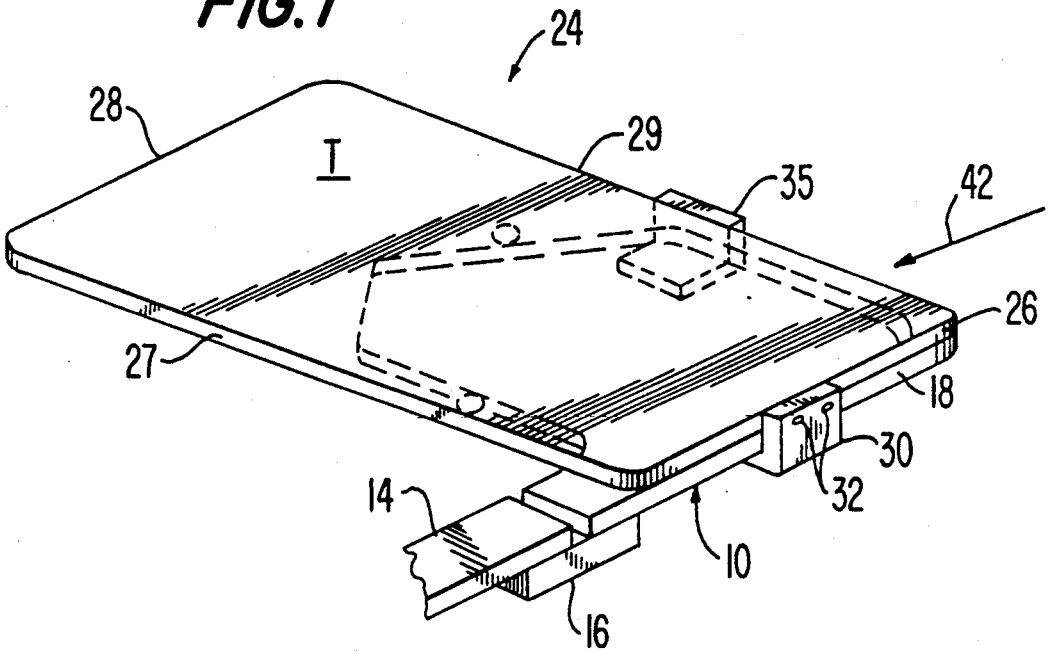
FIG. 1 is a perspective view of a detachable work surface member in accordance with the present invention shown in its position of use on the table of a tablet chair.
Figure 2:
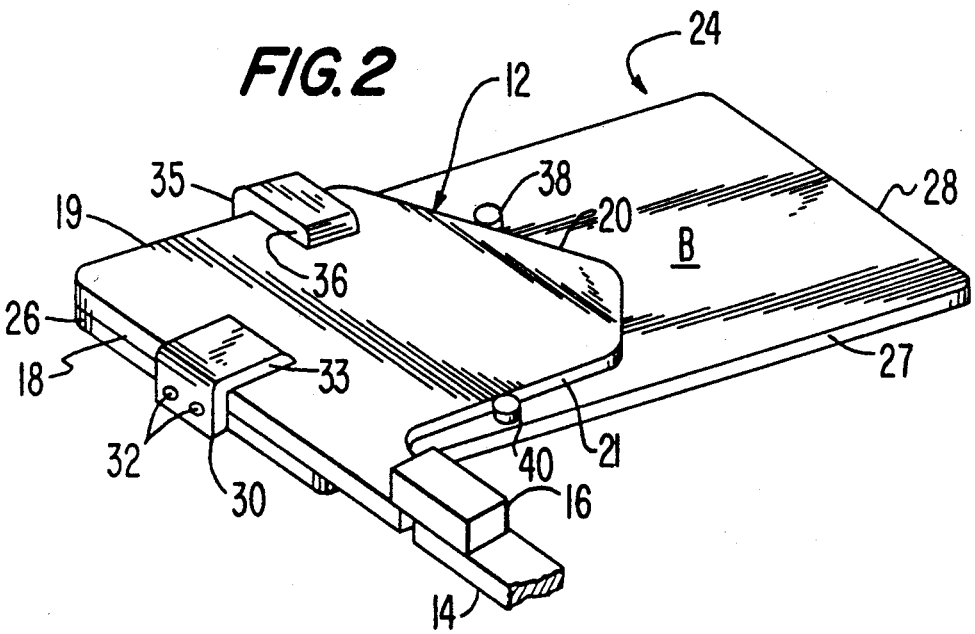
FIG. 2 is a bottom perspective view of the structure of FIG. 1.
Figure 4:
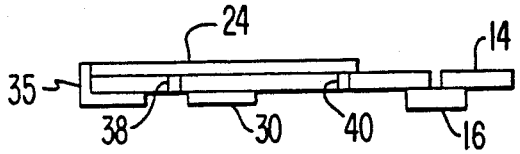
FIG. 4 is a side elevation of the structure of FIGS. 1–3.

Referring first to FIGS. 1 and 2, a chair arm indicated generally at 10 is illustrated as having an enlarged end portion 12 which constitutes the tablet of a tablet arm chair. Arm 10 is the functional extension of a chair arm 14, members 10 and 14 being interconnected by some form of hinge structure 16 which is illustrated simply as a rectangular box because the particular nature of the hinge structure is of no consequence to the present invention. Indeed, the arm need not have any hinge structure at all but can be a solid, unitarily formed and integral structure. However, many tablet chairs manufactured today have some form of structure which allows the tablet to be folded to the side of the chair on which it is mounted and component 16 is illustrated as representing a generic hinge structure of any conventional type.

The tablet indicated generally at 12 has a top surface, a bottom surface and four side edges 18, 19, 20 and 21. While it would be possible to construct a tablet having only three side edges, most have four. In use, the tablet is in the position shown in FIG. 1 with the bottom surface of the tablet extending generally over the legs or knees of the person sitting in the chair connected to arm 14 and, without the structure of the present invention, the top surface would be available to support a notebook or the like.

In order to increase the available work surface, a detachable member in accordance with the present invention is connected to the tablet, the detachable member including a substantially rigid and generally planar body indicated generally at 24, with a top surface T, the body also having side edges 26, 27, 28 and 29 and a bottom surface B which rests on the upper surface of the tablet. A generally L-shaped bracket 30 is attached to edge 26 by fasteners such as screws 32. The leg of bracket 30 which is attached to edge 36 is generally perpendicular to the top and bottom surfaces of body 24 and the other leg 33 of the bracket extends generally parallel with the top and bottom surfaces of body 24 and, when installed, also the top and bottom surfaces of the tablet. The inner, upwardly facing, surface of leg 33 is spaced from the bottom surface of body 24 by a distance which is substantially equal to the thickness of tablet 12 so that the U-shaped opening formed by the bracket and body 24 can be slipped onto the tablet and held in position with very little or no clearance.

A similar bracket 35 is attached to edge 29 of body 24 and also has a leg 36 which has an inner surface parallel with the bottom surface of body 24. Legs 33 and 36 are generally perpendicular to each other so that they are capable of engaging side edges 18 and 19 of tablet 12 as well as the bottom surface of the tablet. As will be recognized from FIG. 1, brackets 30 and 35 constitute hook means which are effective to hold body 24 on the tablet and prevent body 24 from tilting when downward forces are applied to the body from above near edge 28.

In order to keep the detachable member in the position shown in FIGS. 1–4, additional stop members 38 and 40 are attached to and protrude from the bottom surface of body 24. Stop member 38 can be a fixed member of substantially any shape attached to the under surface of body 24 in any suitable fashion. Member 40, however, must be in some way so that body 24 can be attached to and detached from the tablet. Stop member 40 can be a retractable peg or button which is spring-urged to its protruding position, a suitable arrangement being illustrated in FIG. 10 to which further reference will be made subsequently.

To install the detachable member shown in FIGS. 1–4 on the tablet, stop member 40 is depressed to its retracted position, either by hand or by placing it against the upper surface of tablet 12, with body 24 substantially parallel with tablet 12 and with the bottom surface of the body in contact with the top surface of the tablet. Body 24 is then moved, parallel with itself, in the general direction of arrow 42 in FIG. 1 until brackets 30 and 35 are adjacent edges 18 and 19 of tablet 12 and until stop member 38 is adjacent edge 20. At that time, stop member 40 will have passed beyond edge 21 and moved to its extended or protruding position, as illustrated in FIG. 2. In this position, body 24 is securely attached to tablet 12 and can be pivoted along with tablet 12 without being separated therefrom.

As will be readily apparent, a particular detachable member 24 is preferably constructed taking into consideration the specific shape of the tablet to which it will be attached. However, it will also be apparent that a member 24 can be constructed to accommodate substantially any shape of tablet simply by appropriately locating the hook means and stop members.

Figure 5:
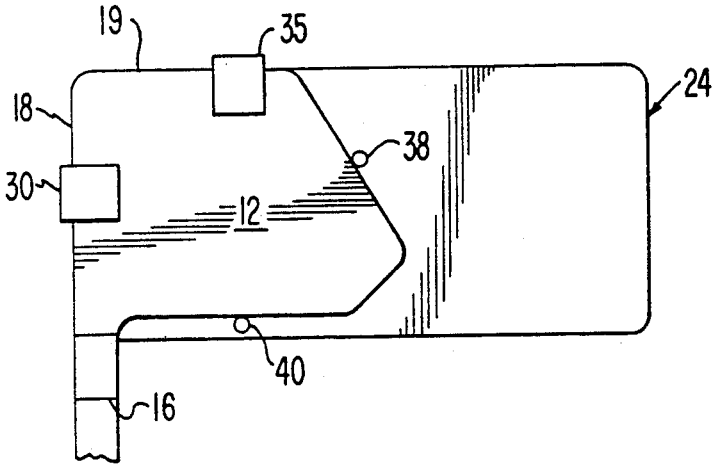
FIGS. 5, 6 and 7 are schematic bottom plan views of a chair tablet and detachable work surface member showing various possible arrangements of hook means and stop members.
Figure 6:
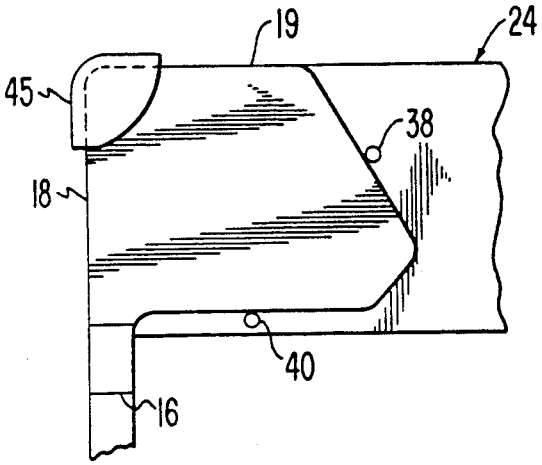

It will also be apparent that arrangements of the hook means and stop members other than the arrangement shown in FIGS. 1–4 can be utilized. FIG. 5 shows a bottom plan view of the arrangement of FIGS. 1–4 for purposes of comparison. FIG. 6 illustrates an embodiment in which the two hook means are combined into a single hook member 45 which is shaped with a curved or bent wall portion capable of engaging both side edges 18 and 19 of tablet 12 by itself. Stop means 38 and 40 are as previously described and the method of applying the detachable member to the tablet is the same as previously described. The embodiment of FIG. 6 is believed to be the full functional equivalent of the embodiment of FIGS. 1–5. However, the brackets of FIGS. 1–5 are easier to make without expensive molds while bracket 45 of FIG. 6 requires more complicated molding or machining of some type.

Figure 7:
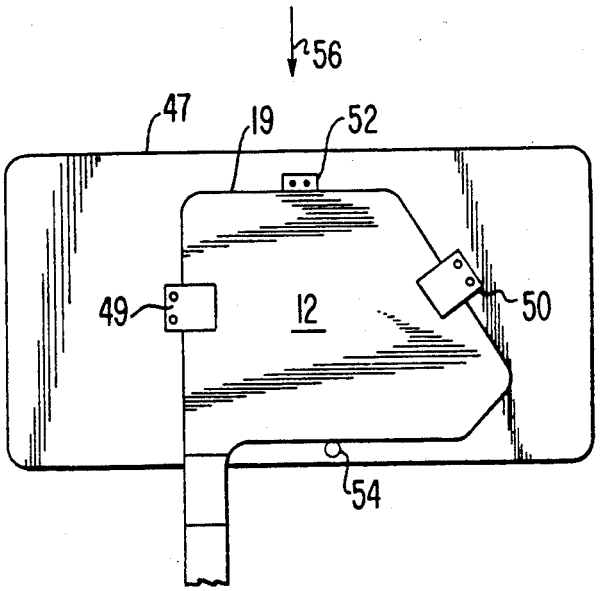

The embodiments of FIGS. 1–6 are constructed with the hook means attached to an end or side edge of member 24 and the result is that edges 26 and 18 lie in substantially the same plane while edges 19 and 29 also lie in the same plane. There may, however, be circumstances in which it is desirable to have all of the edges of the detachable member protrude beyond the edges of tablet 12. FIG. 7 illustrates an arrangement of this type in which a body 47 is provided with brackets 49 and 50 attached to the underside of body 47 rather than to the edges thereof. A stop member 52 is also attached to the underside to engage edge 19 of the tablet. Finally, a retractable stop member 54, which can be constructed in the manner of FIG. 40, is provided to engage edge 21 of the tablet.

The embodiment of FIG. 7 is assembled in substantially the same manner as the other embodiments, i.e., by retracting stop member 40 and sliding body 47 onto the tablet in the direction of arrow 56 until stop member 54 is restored to its protruding position.

Figure 8:
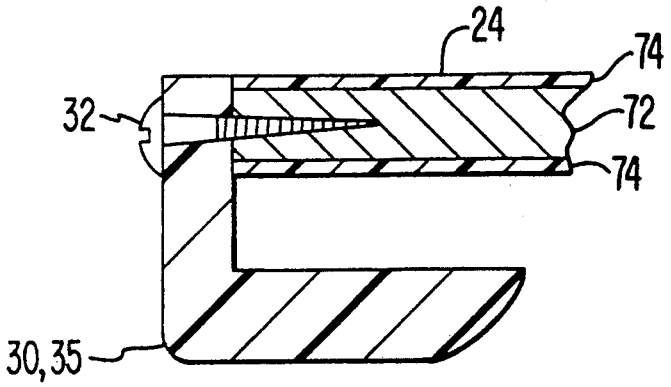
FIGS. 8 and 9 are front elevations illustrating alternative forms of hook means usable in the foregoing embodiments.

FIG. 8 illustrates in greater detail an assembly technique for brackets 30 or 35 in which the brackets are attached to body 24 by screws 32.

Figure 9:
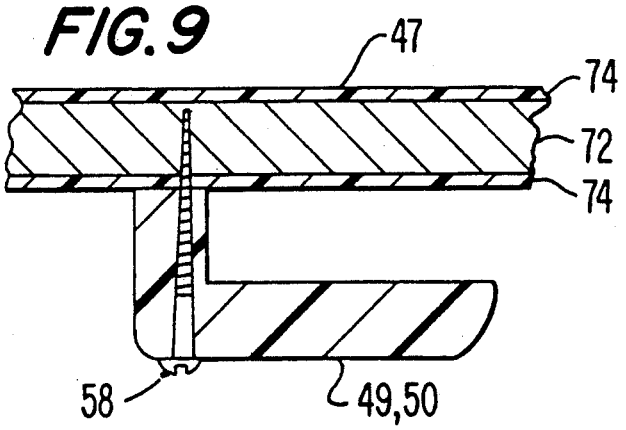

FIG. 9 illustrates the attachment of a bracket 49 or 50 to the bottom surface of body 47 using screws 58 which extend through the leg and into the under surface of body 47. Other attachment techniques are, of course, quite possible including the use of pegs and/or adhesives.

Figure 10:
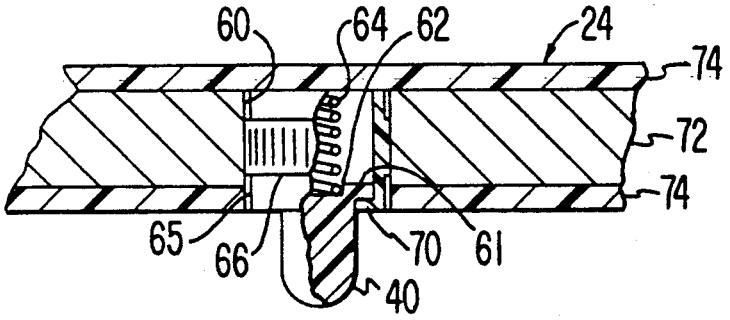
FIG. 10 shows a retractable stop member.
Figure 3:
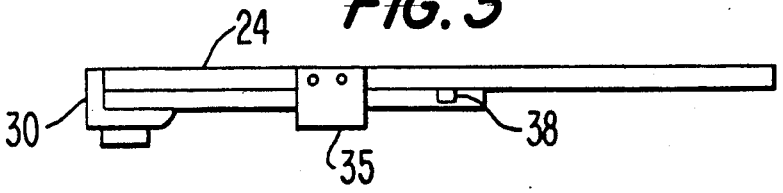
FIG. 3 is a front elevation of the structure shown in FIGS. 1 and 2.

FIG. 10 shows retractable stop member 40 which is received in a recess 60 of body 24. The protruding end of the stop member itself is illustrated as a generally cylindrical, peg-like member with a rounded end but other shapes can easily be employed, if desired. Member 40 has an enlarged upper end 61 with a recess 62 which receives one end of a compression coil spring 64, the other end of which abuts the inner end of recess 60, to urge the stop member toward its protruding position. Enlarged end 61 is received in a tubular sleeve 65 which is formed with a slightly larger annular band 66. Band 66 is formed with straight, axial ribs or knurling 68 and is dimensioned to press-fit in recess 60 so that sleeve 65 is held securely therein. Adjacent the lower surface of body 24 sleeve 65 has an annular, inwardly extending flange 70 to prevent enlarged end 61 from being pushed out of the sleeve.

As will be recognized, bodies 24 and 47 can be made of a piece of wood or plastic or, as suggested in FIGS. 8–10, by a central core of wood or particle board 72 laminated on one or both sides with sheets of polymeric material 74 to provide a smooth, durable and attractive writing surface, materials such as that sold under the trademark FORMICA being particularly suitable.

While certain advantageous embodiments have been chosen to illustrate the invention, various changes and modifications can be made without departing from the scope of the invention as defined by the appended claims.

What is claimed is:

1. A detachable member for increasing the work surface area of a tablet on a tablet chair, the tablet being of the type having a top surface, a bottom surface and a plurality of side edges, the member comprising the combination of a substantially rigid, generally planar body positionable for use on top of the tablet, the body having a top work surface with an area significantly greater than the top surface of the tablet and a bottom surface positionable on said top surface of said tablet;

hook means attached to said body for extending under said tablet with said body positioned on top of said tablet and for engaging two side edges and said bottom surface of said tablet;

a first stop member protruding from the bottom surface of said body, said first stop member being spaced from said hook means a sufficient distance to engage a third side edge of said tablet;

means defining a recess in said body extending upwardly from said bottom surface; and a second stop member protruding from said bottom surface of said body, said second stop member being spaced from said hook means a sufficient distance to engage a fourth side edge of said tablet;

one of said first and second stop members being retractable above said bottom surface of said body to allow attachment and detachment of said body to and from said tablet, said one of said members including a member shaped to be received in said recess and spring means for urging said member toward its protruding position.

* * * * *